US007856681B2

(12) United States Patent
Alls

(10) Patent No.: US 7,856,681 B2
(45) Date of Patent: Dec. 28, 2010

(54) INTEGRATED DRAIN AND FOUNTAIN DEVICE

(76) Inventor: Kionn Alls, 390 N. Orange Ave., Suite 2300, Orlando, FL (US) 32801

( * ) Notice: Subject to any disclaimer, the term of this patent is extended or adjusted under 35 U.S.C. 154(b) by 501 days.

(21) Appl. No.: 12/025,961

(22) Filed: Feb. 5, 2008

(65) Prior Publication Data

US 2008/0184482 A1 Aug. 7, 2008

Related U.S. Application Data

(60) Provisional application No. 60/888,128, filed on Feb. 5, 2007.

(51) Int. Cl.
*A47K 1/04* (2006.01)
*E03C 1/02* (2006.01)

(52) U.S. Cl. ..... 4/619

(58) Field of Classification Search ..... 4/619, 4/624, 443–448, 490, 650–653; 239/20
See application file for complete search history.

(56) References Cited

U.S. PATENT DOCUMENTS 1,805,560 A * 5/1931 Barta ..... 4/651
4,589,438 A * 5/1986 Breda ..... 137/218
6,684,813 B1 * 2/2004 Lemon ..... 119/69.5
6,848,124 B2 * 2/2005 Goettl ..... 4/490

* cited by examiner

*Primary Examiner*—Charles Phillips
(74) *Attorney, Agent, or Firm*—ShuffieldLowman; Matthew G. McKinney

(57) ABSTRACT

An integrated drain and fountain device having a stationary fountain nozzle integrated within a lower portion of a sink and disposed to produce a vertical stream of water at a user-defined water pressure. A concentrically located drain to the fountain nozzle is adapted to receive and collect water and is in fluid communication with drain piping. A water supply riser is in fluid communication with a water intake pipe that allows both hot and cold water to enter the water supply riser so that water can be discharged through the fountain nozzle. A controller for the fountain device is located on a counter top so that when a downward force is applied to the controller, the downward force is directed through a linkage including a flexible arm that redirects the downward force to an upward force causing an o-ring stopper of the integrated drain and fountain device to move vertically.

15 Claims, 12 Drawing Sheets

INTEGRATED DRAIN AND FOUNTAIN DEVICE

CROSS-REFERENCED TO RELATED APPLICATIONS

This application claims the benefit of U.S. Provisional Application No. 60/888,128 filed Feb. 5, 2007. The disclosure of the provisional application is incorporated herein by reference.

FIELD OF THE INVENTION

The present invention relates to the field of plumbing, wash sink fixtures and, more particularly, to a sink that incorporates an integrated drain and fountain device instead of a traditional spout tap as a water source.

DESCRIPTION OF THE PRIOR ART

In recent years plumbing fixtures, in particular, sinks and faucets have undergone changes in design that made them more aesthetically appealing while still retaining the traditionally configured sink surmounted by a faucet and associated water control knobs or levers. These design changes have changed only the appearance and not affected the configuration of the sink and faucet, which has remained unchanged since the 19th century. Accordingly, there is a need in the art for a novel, non-obvious and improved sink that advantageously provides a novel means of delivering water to the sink that is energy efficient and aesthetically pleasing. It is, therefore, to the effective resolution of the aforementioned problems and shortcomings of the prior art that the present invention is directed. However, in view of the prior art at the time the present invention was made, it was not obvious to those of ordinary skill in the pertinent art how the identified needs could be fulfilled.

SUMMARY OF THE INVENTION

This invention is an integrated drain and fountain device comprising a stationary fountain nozzle integrated within a lower portion of a sink and disposed to produce a vertical stream of water at a user-defined water pressure. A concentrically located drain to the fountain nozzle is adapted to receive and collect water and is in fluid communication with drain piping. A water supply riser is in fluid communication with a water intake pipe and the fountain nozzle that allows both hot and cold water to enter the water supply riser so that water can be discharged through the fountain nozzle. A controller for the fountain device is located on a counter top so that when a downward force is applied to the controller, the downward force is directed through a linkage including a flexible arm that redirects the downward force to an upward force. The upward force causes an o-ring stopper of the integrated drain and fountain device to move vertically so that the sink is permitted to fill with water. An outer cylinder module within the invention includes a plurality of open grooves disposed concentrically to an inner cylinder module that has a plurality of ridges extending from its periphery so that as the inner cylinder module rises in response to the upward force of the linkage, the plurality of notches are raised up out of the plurality of open grooves of the outer cylinder module causing the inner cylinder module to rotate to an adjacent position. In addition, a spring disposed between the o-ring stopper and the inner cylinder module causes the inner module to rotate to an adjacent position as a compression force is applied using the linkage and controller.

The integrated drain and fountain device replaces the faucet in the traditional plumbing configuration and the water controls are moved to the front of the sink thus allowing a bathroom vanity to be more streamlined, maximizing useable counter-top space.

It is therefore an object of the present invention to provide for an improvement that overcomes the aforementioned inadequacies of the prior art and provides a significant contribution to the advancement of sinks and faucets.

Both the foregoing general description and the following detailed description are explanatory and are not restrictive of the invention as claimed. The accompanying drawings, which are incorporated in and constitute part of the specification, illustrate embodiments of the present invention and together with the general description, serve to explain principles of the present invention.

BRIEF DESCRIPTION OF THE DRAWINGS

Some of the features, advantages, and benefits of the present invention having been stated, others will become apparent as the description proceeds when taken in conjunction with the accompanying drawings, presented solely for exemplary purposes and not with intent to limit the invention thereto, and in which.

DETAILED DESCRIPTION

The present invention will now be described more fully hereinafter, in which description preferred embodiments of the invention are discussed. Unless otherwise defined, technical and scientific terms used herein have the same meaning as commonly understood by one of ordinary skill in the art to which this invention pertains. Although methods and materials similar or equivalent to those described herein can be used in the practice or testing of the present invention, suitable methods and materials are described below. In addition, the materials, methods and examples given are illustrative in nature only and not intended to be limiting. Accordingly, this invention may be embodied in many different forms and should not be construed as limited to the illustrated embodiments set forth herein. Rather, these illustrated embodiments are provided solely for exemplary purposes so that this disclosure will be thorough and complete, and will fully convey the scope of the invention to those skilled in the art. Other features and advantages of the invention will be apparent from the following detailed description.

Figure 1:
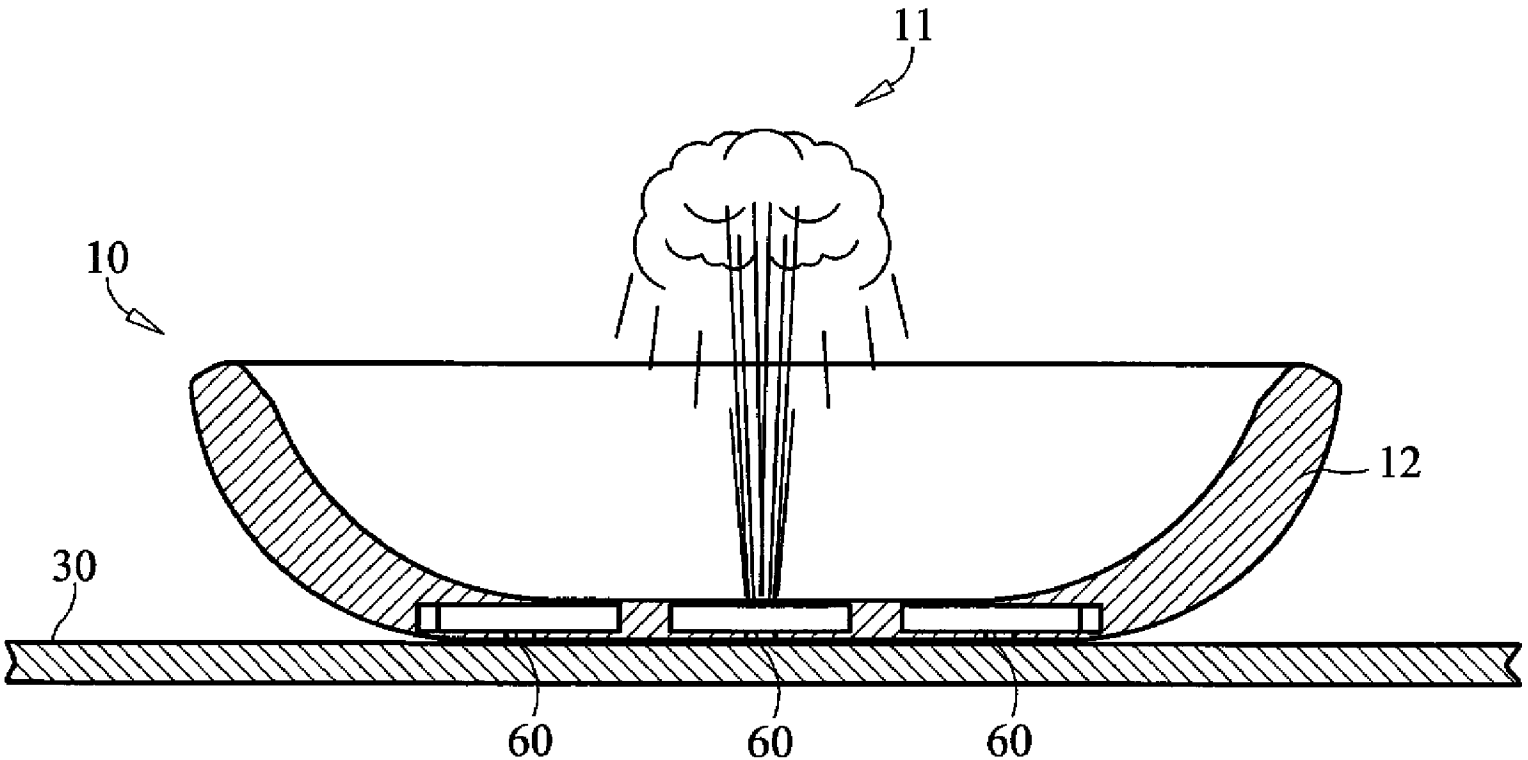
FIG. 1 is a cut view of a sink showing water flowing vertically from a fountain device and three flat surface controls according to an embodiment of the present invention.

This invention 10 relates to a sink with an integrated drain and fountain device. Referring now to FIG. 1, controls 60 are located proximate to the sink 12 and orientated to be adjacent to counter top 30. Upon demand by a user, a vertical water spout 11 exits the integrated drain and fountain device located in the lower portion of the sink 12.

Figure 2:
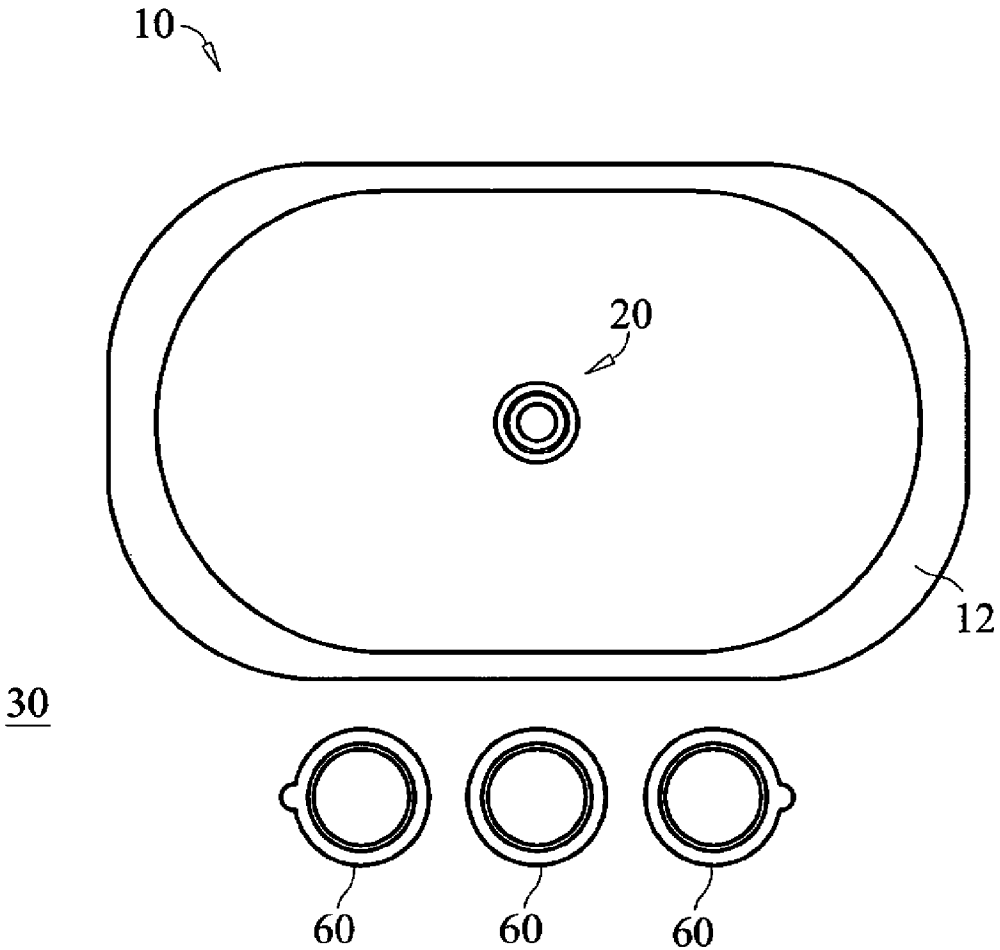
FIG. 2 is a top view of the sink showing an integrated drain and fountain device and three flat surface controls according to an embodiment of the present invention.
Figure 3:
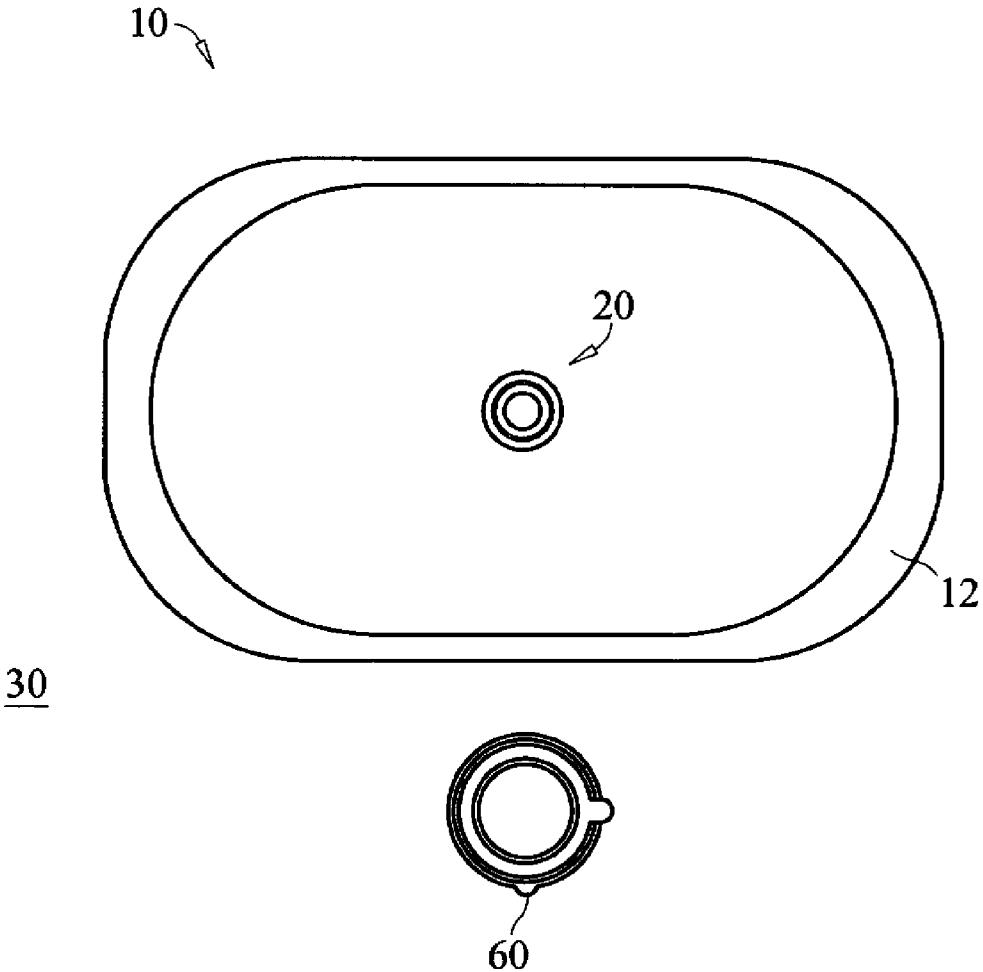
FIG. 3 is a top view of the sink of the invention showing an integrated drain and fountain device and an alternative embodiment of a single flat surface control for introducing hot and cold water therein and for opening and closing the drain according to an alternative embodiment of the present invention.

Referring now to FIG. 2, the integrated drain and fountain device 20 is shown centrally located in the sink 12. Three controls 60 are in front of the sink 12 to provide easy access to the user as he/she is standing at the countertop 30. The controls 60 are for the regulation of temperature and drainage and can be recessed, flush or raised slightly above the counter top 30. While it is preferable to locate the controllers 60 in front of the sink 12, in keeping with the novel design and aesthetics of the invention 10, placing the controllers 60 in alternate locations and using the controllers 60 with alternate plumbing arrangements, for example a shower or tub, is also possible. Matching, complementary or contrasting veneer in glass, porcelain, stone such as marble, granite, onyx or slate, as well as metals such as stainless steel, nickel, gold, copper and alloys thereof may be applied to the integrated drain and fountain device 20 and/or controllers 60 to match, complement or contrast the sink 12, the counter top 30 and/or fixtures. As shown in FIG. 3, a single control 60 located in front of the sink 12 is an alternative embodiment.

Figure 4:
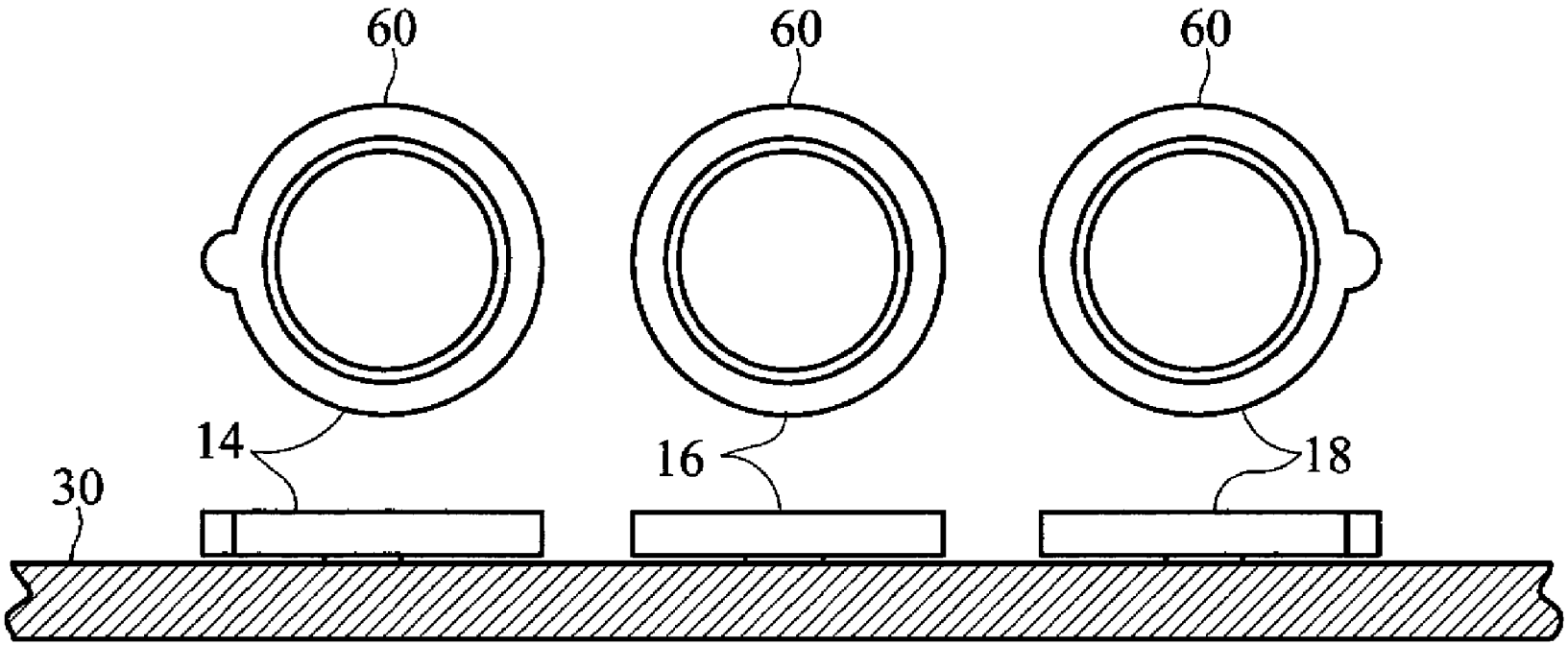
FIG. 4 is a top and side view of three flat surface controls, where each controller is comprised of a single piece according to an embodiment of the present invention.

FIG. 4 illustrates top and side views of a control system with three controllers 60, raised slightly above a countertop 30 as also shown in FIGS. 1 and 2. In this embodiment, each of the three controllers 60 comprises a single piece disc. A first disc 14 of the first controller 60 is turned clockwise to activate the flow of hot water, and counterclockwise to stop the flow of hot water. A second disc 16 of the second controller 60 raises and lowers either an o-ring stopper or a fountain nozzle and is dependent upon the plumbing arrangement selected for the fountain device. To raise the o-ring stopper or the fountain nozzle, the second disc 16 is depressed once; depressing the second disc 16 again will lower the o-ring stopper or the fountain nozzle. A third disc 18 of the third controller 60 is turned counterclockwise to activate the flow of cold water, and clockwise to stop the flow of cold water.

Figure 5:
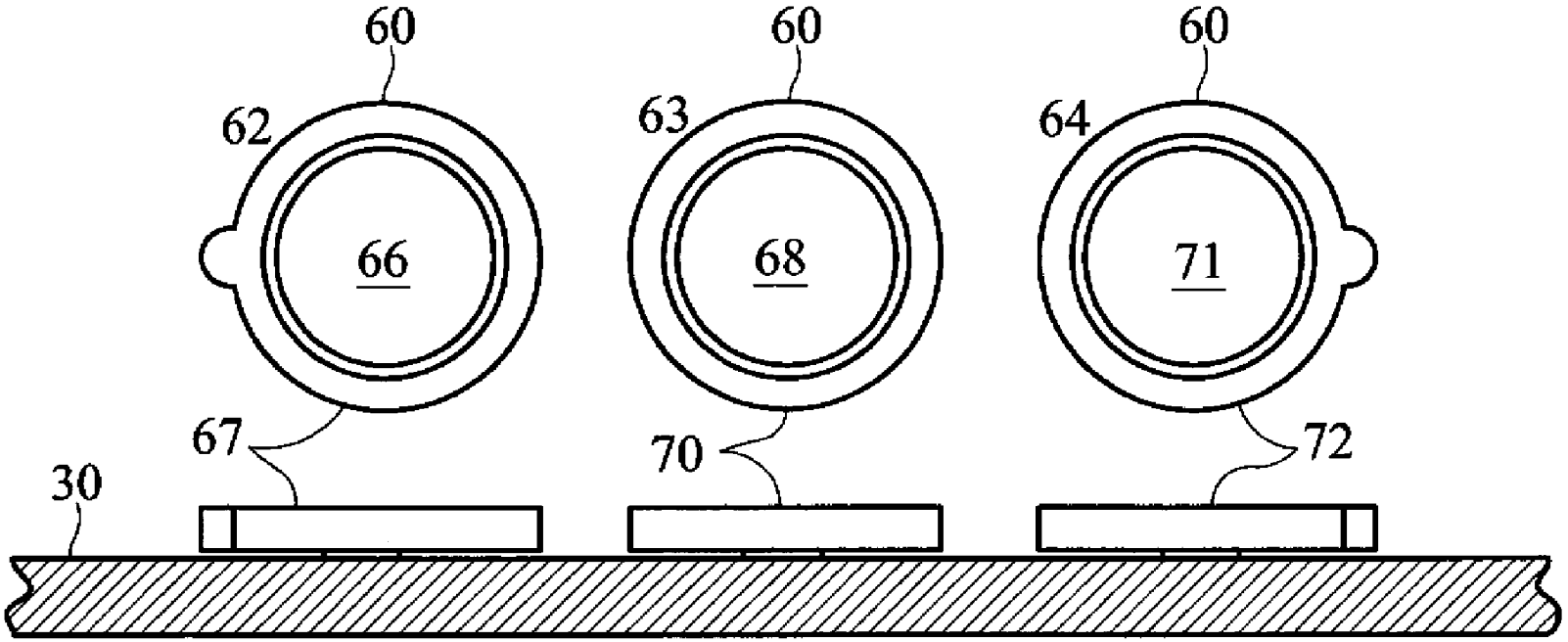
FIG. 5 is a top and side view of an alternative embodiment of three flat surface controls, wherein each controller is comprised of two pieces according to an alternative embodiment of the present invention.

The configuration of FIG. 5 shows an alternative embodiment of a control system with three controllers 60 raised slightly above a countertop 30, illustrated in top and side views, where each controller 60 is comprised of two pieces. A first disc 62 of the first controller 60 is comprised of an outer ring 67 that controls the flow of hot water, and a stationary inner disc 66. The outer ring 67 is turned clockwise to activate the flow of hot water, and counterclockwise to stop the flow of hot water. A second disc 63 of the second controller 60 is comprised of an outer ring 70 that controls the water pressure, and thus the height of the water spout 11 discharged from the fountain device and a stationary center control disc 68. A stationary center control disc 68 raises and lowers either an o-ring stopper or the fountain nozzle and is dependent upon the plumbing arrangement selected for the fountain device. To raise the o-ring stopper or the fountain nozzle, a stationary center control disc 68 is depressed once; depressing the stationary center control disc 68 again will lower either the o-ring stopper or the fountain nozzle. A third disc 64 of the third controller is comprised of a outer ring 72 that controls the flow of cold water, and a stationary inner disc 71. The outer ring 72 is turned counterclockwise to activate the flow of cold water, and clockwise to stop the flow of cold water.

Figure 6:
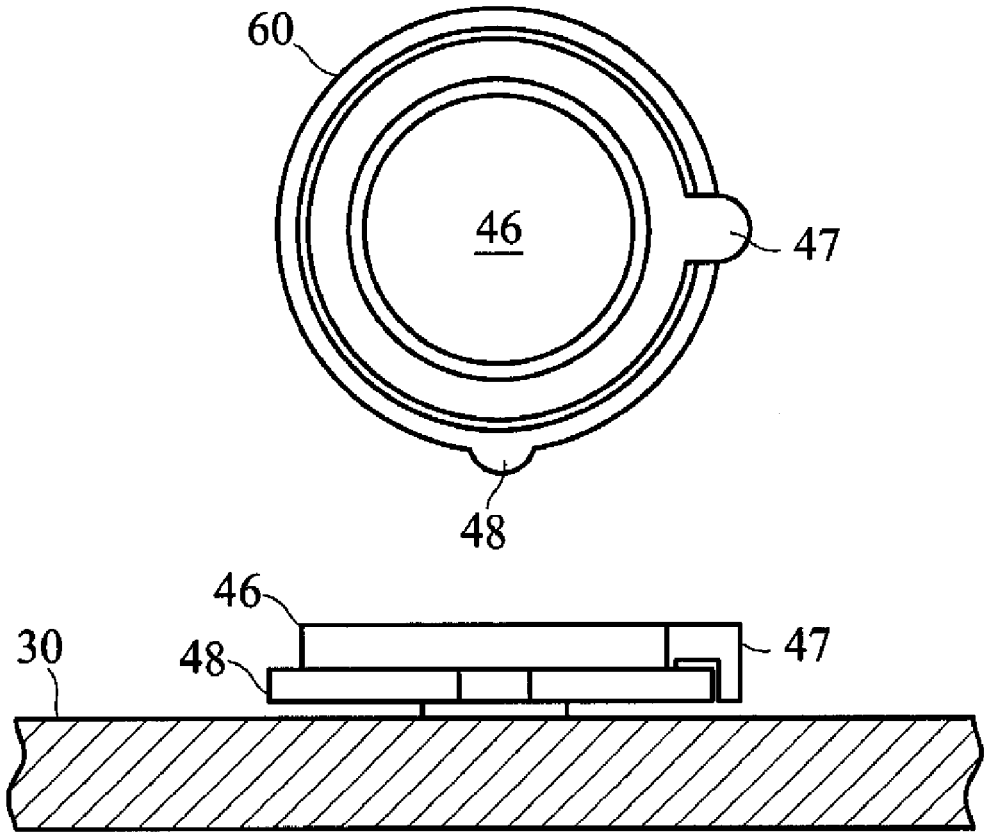
FIG. 6 is a top and side view of a one flat surface control shown in FIG. 3, where the controller is comprised of three pieces according to an alternative embodiment of the present invention.

Another configuration for controlling the introduction of water and drainage is illustrated in FIG. 6, which is also shown in FIG. 3. In this embodiment, a single controller 60 that is raised slightly above the countertop 30, comprising three separate control rings 46, 47, 48, is illustrated in top and side views. A stationary center control ring 46 is used to raise the o-ring stopper or the fountain nozzle, a middle control ring 47 controls hot and cold water, and an outer control ring 48 controls water pressure and thus, the height of a water spout 11 discharged from the fountain nozzle. The stationary center control disc 46 is operated by depressing it once to raise an o-ring stopper or the fountain nozzle, and by depressing the stationary center control disc 46 again to lower either the o-ring stopper or the fountain nozzle. The middle control ring 47 is turned counterclockwise to activate the flow of water; as the middle control ring 47 is turned counterclockwise, the water temperature progresses from cold to hot. The middle control ring 47 is turned clockwise to stop the flow of water; as the middle control ring 47 is returned to its original position, as illustrated in FIG. 6, the water temperature progresses from hot to cold. The outer control ring 48 is turned clockwise to increase water pressure. The outer control ring 48 is turned counterclockwise to its original position, as illustrated in FIG. 6, to lower water pressure.

Figure 7:
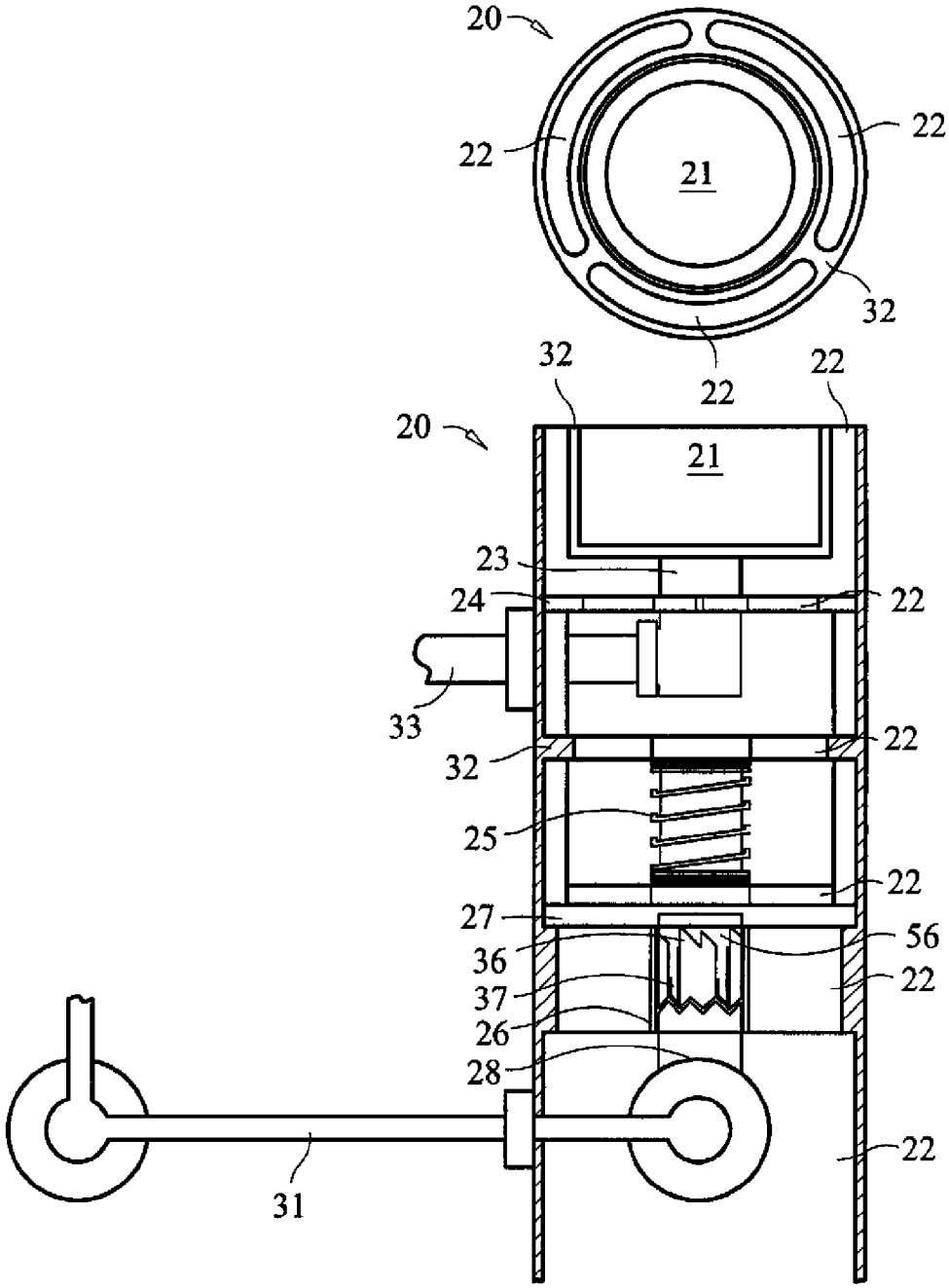
FIG. 7 is a top and side view of a stationary fountain device in an open position according to an embodiment of the present invention.
Figure 8:
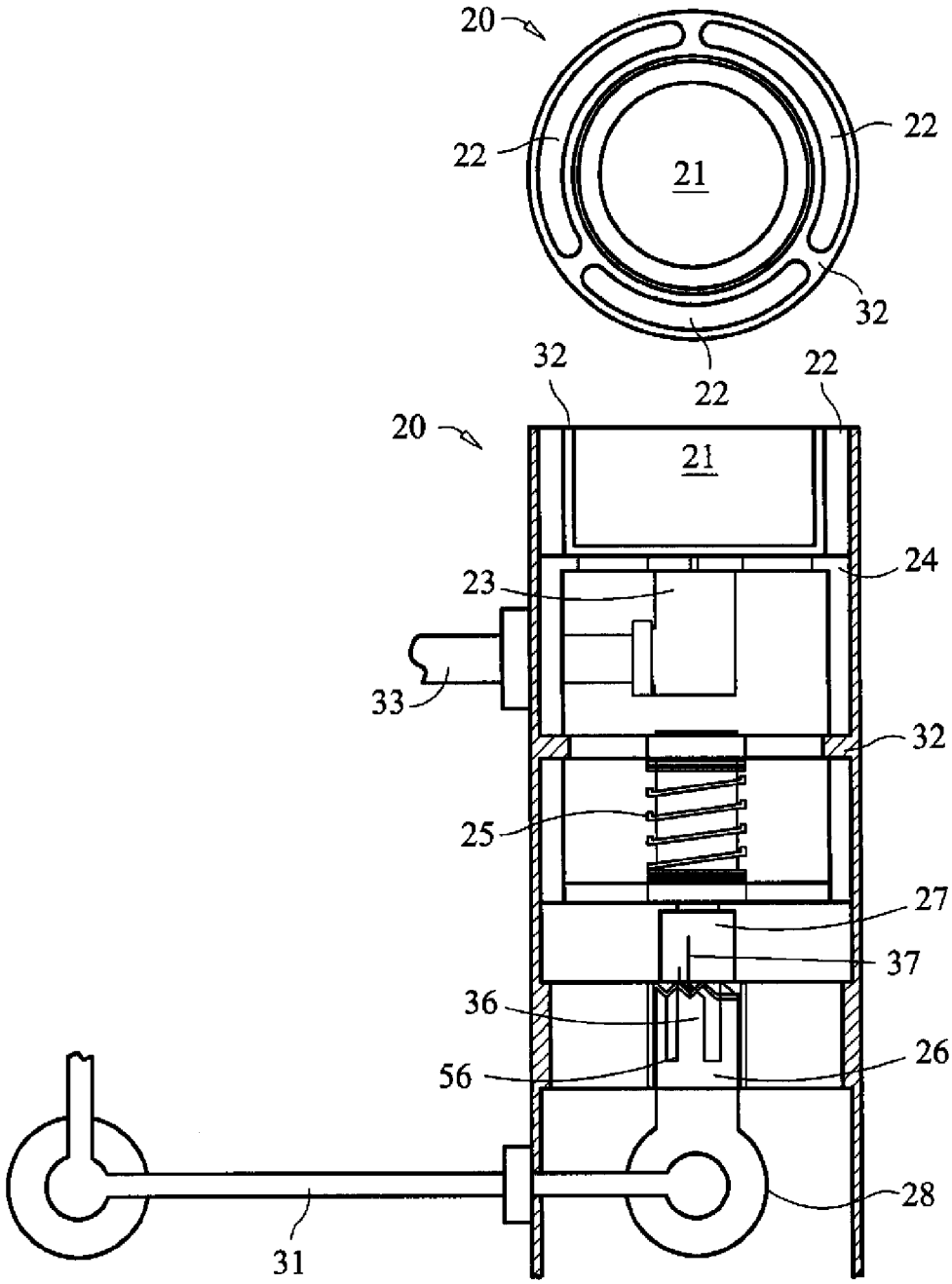
FIG. 8 is a top and side view of a stationary fountain device in a closed position according to an embodiment of the present invention.

FIGS. 7 and 8 illustrate a stationary version of the fountain device 20 shown in top and side views. In this embodiment, the fountain device 20 comprises a stationary fountain nozzle 21, a concentrically located drain 22, a water supply riser 23, an o-ring stopper 24 (cross-sectioned side view), a spring 25, an outer cylinder module 26, an inner cylinder module 27, a lower module 28 and associated plumbing 32 (cross-sectioned side view). The inner cylinder module 27 includes a rotating cylinder with a plurality of raised notches 37 rising outward from its surface. The outer cylinder module 26, which is concentrically related to the inner cylinder module 27, remains stationary and has a plurality of ridges 36 and open grooves 56. Together with FIG. 8, FIG. 7 shows how the fountain device 20 operates under routine conditions. When in use, water is introduced into a water intake pipe 33 that allows both hot and cold water to enter the water supply riser 23 so that water can be discharged through the fountain nozzle 21. A thin screen or mesh is ideally situated over the fountain nozzle 21 to prevent debris from entering the fountain nozzle 21.

As shown in FIGS. 7 and 8, the o-ring stopper 24 of the stationary fountain device 20 is operationally controlled by controller 60 located on a counter top 30. If the fountain faucet assembly 20 is in an open position as illustrated in FIG. 7, as previously discussed in relation to FIGS. 4, 5, and 6, when a downward force is applied to controller 60, that downward force is directed through a linkage including a flexible arm 31 that redirects the force upward against the lower module 28, inner cylinder module 27 and o-ring stopper 24, causing them to rise, compressing spring 25. As the inner cylinder module 27 rises, its notches 37 are raised up out of the open grooves 56 of the outer cylinder module 26. Once the notches 37 of the inner cylinder module 27 are completely free of the open grooves 56 of the outer cylinder module 26, the inner cylinder module 27 rotates slightly. As the compression force on the spring 25 dissipates, the spring 25 expands causing the notches 37 of the inner cylinder module 27 to rest on top of the ridges 36 of the outer cylinder module 26, which causes the o-ring stopper 24 to remain elevated in the closed position, as illustrated in FIG. 8, sealing off the drain 22 so that the sink 12 is permitted to fill with water.

A subsequent downward force on controller 60 again causes the spring 25 to compress in the manner previously described, which causes the inner cylinder module 27 to rise and rotate. As the compression force on the spring 25 dissipates, the spring 25 expands forcing the notches 37 of the inner cylinder module 27 into the open grooves 56 of the outer cylinder module 26. As the notches 37 of the inner cylinder module 27 lowers to the bottom of the open grooves 56 of the outer cylinder module 26, the o-ring stopper 24 is lowered to the open position as illustrated in FIG. 7. When this occurs, the sink 12 is permitted to drain through at least one, but preferably three (or more), drain openings 22.

Figure 9:
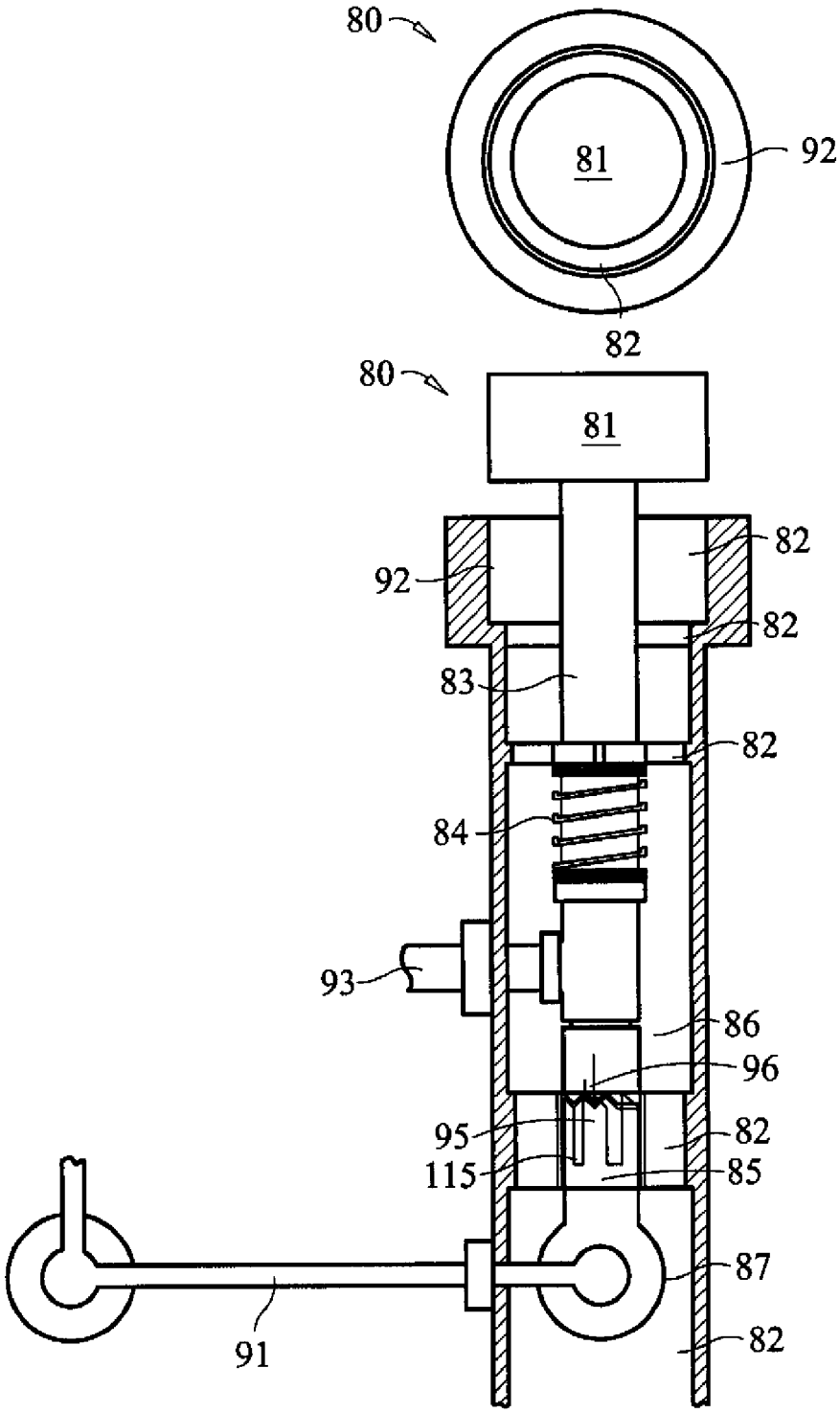
FIG. 9 is a top and side view of a fountain device in an open position having a pop-up module according to an embodiment of the present invention.
Figure 10:
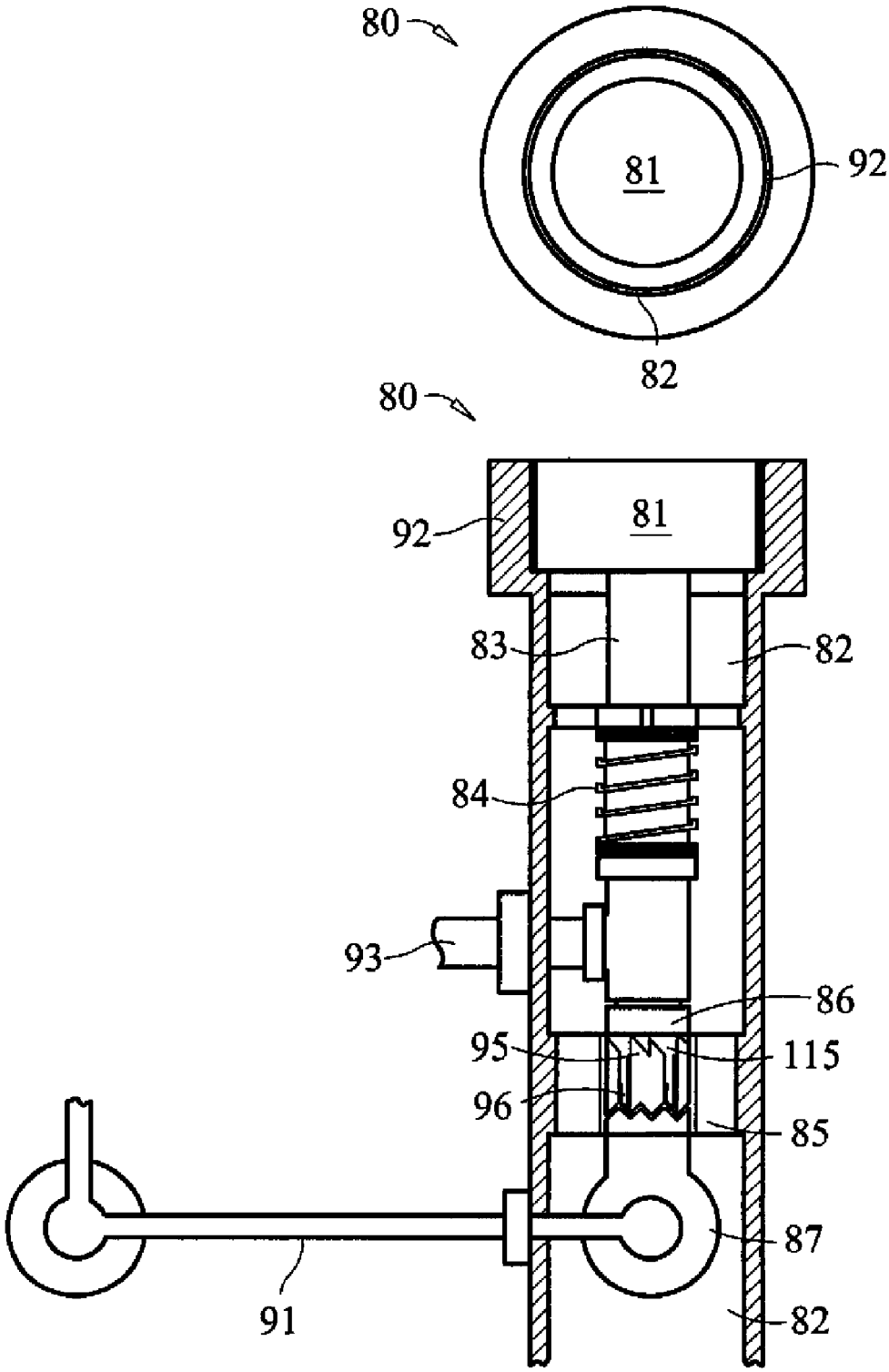
FIG. 10 is a top and side view of a fountain device in a closed position having a pop-up module according to an embodiment of the present invention.

FIGS. 9 and 10 illustrate an alternative embodiment of a fountain device 80 shown in top and side views. In this embodiment, the fountain device 80 comprises a fountain nozzle 81 that is adaptable to slide within concentrically located drain 82, a water supply riser 83, a spring 84, an outer cylinder module 85, an inner cylinder module 86, a lower module 87 and associated plumbing. The inner cylinder module 86 includes a rotating cylinder with a plurality of raised notches 96 rising outward from its periphery. The outer cylinder module 85, which is concentrically located to the inner cylinder module 86, remains stationary and has a plurality of ridges 95 and open grooves 115. Together with FIG. 10, FIG. 9 shows how the fountain device assembly 80 operates under routine conditions. When in use, water is introduced into a water intake pipe 93 that allows both hot and cold water to enter the water supply riser 83 so that water can be discharged through the fountain nozzle 81. A thin screen or mesh is ideally situated over the fountain nozzle 81 to prevent debris from entering the fountain nozzle 81.

As shown in FIGS. 9 and 10, the fountain device 80 is operationally controlled by controller 60 located on a counter top 30. If the fountain device 80 is in an open position as illustrated in FIG. 9, when a downward force is applied to a center controller 60, that downward force is directed through a linkage including a flexible arm 91 that redirects the force upward against the lower module 87, inner cylinder module 86, water supply riser 83 and fountain nozzle 81, causing them to rise, compressing the spring 84. As the inner cylinder module 86 rises, it rotates slightly. As the compression force on the spring 84 dissipates, the spring 84 expands forcing the notches 96 of the inner cylinder module 86 into the open grooves 115 of the outer cylinder module 85. As the notches 96 of the inner cylinder module 86 lowers to the bottom of the open grooves 115 of the outer cylinder module 85, the water supply riser 83 and fountain nozzle 81 are lowered to the closed position, as illustrated in FIG. 10, sealing off the drain 82 so that the sink 12 is permitted to fill with water.

A subsequent downward force on controller 60 again causes the spring 84 to compress in the manner previously described, which causes the inner cylinder module 86 to rise. As the inner cylinder module 86 rises, its notches 96 are raised up out of the open grooves 115 of the outer cylinder module 85. Once the notches 96 of the inner cylinder module 86 are completely free of the open grooves 115 of the outer cylinder module 85, the inner cylinder module 86 rotates slightly. As the compression force on the spring 84 dissipates, the spring 84 expands causing the notches 96 of the inner cylinder module 86 to rest on top of the ridges 95 of the outer cylinder module 85, which causes the water supply riser 83 and fountain nozzle 81 to remain elevated in the open position as illustrated in FIG. 9. When this occurs, the sink 12 is permitted to drain through at least one drain opening 82.

Figure 11:
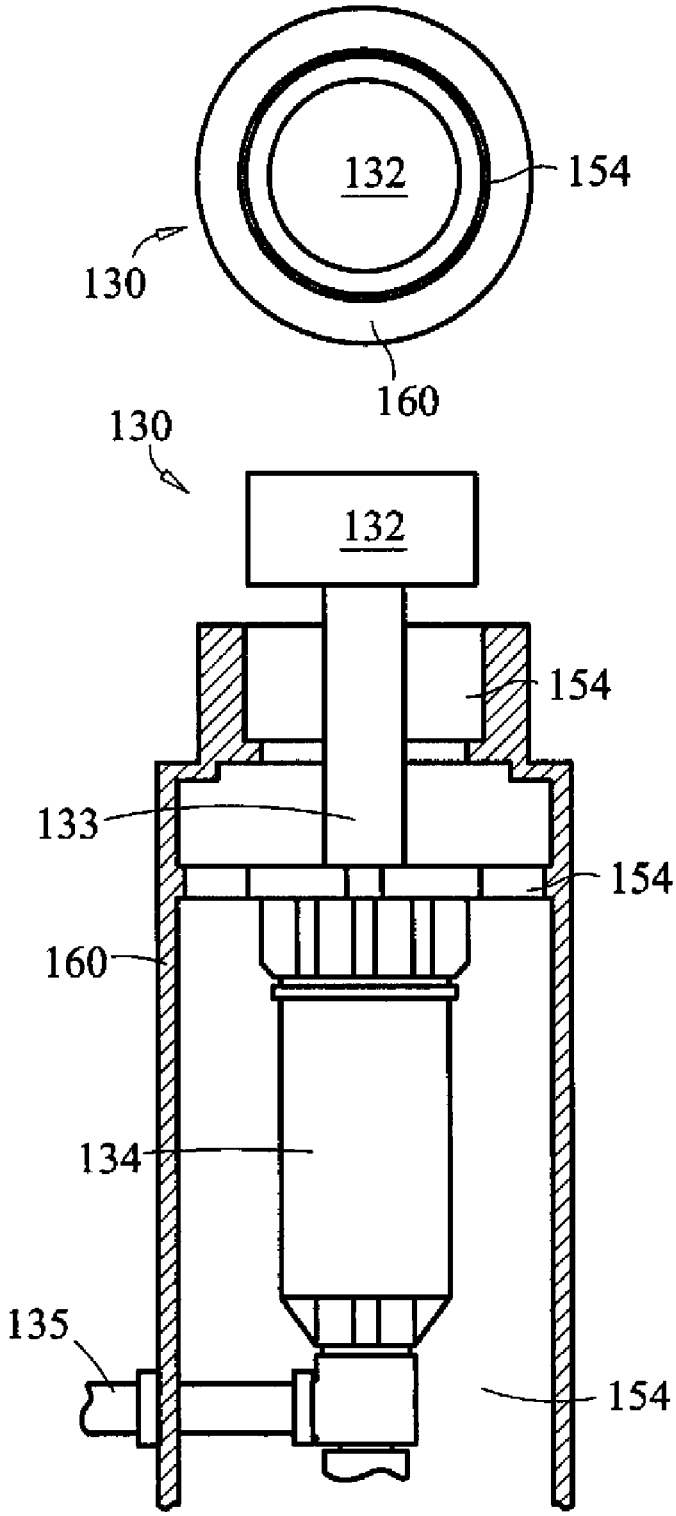
FIG. 11 is a top and side view of a fountain device in an open position having a water pressure activated, spring action pop-up module according to an embodiment of the present invention.
Figure 12:
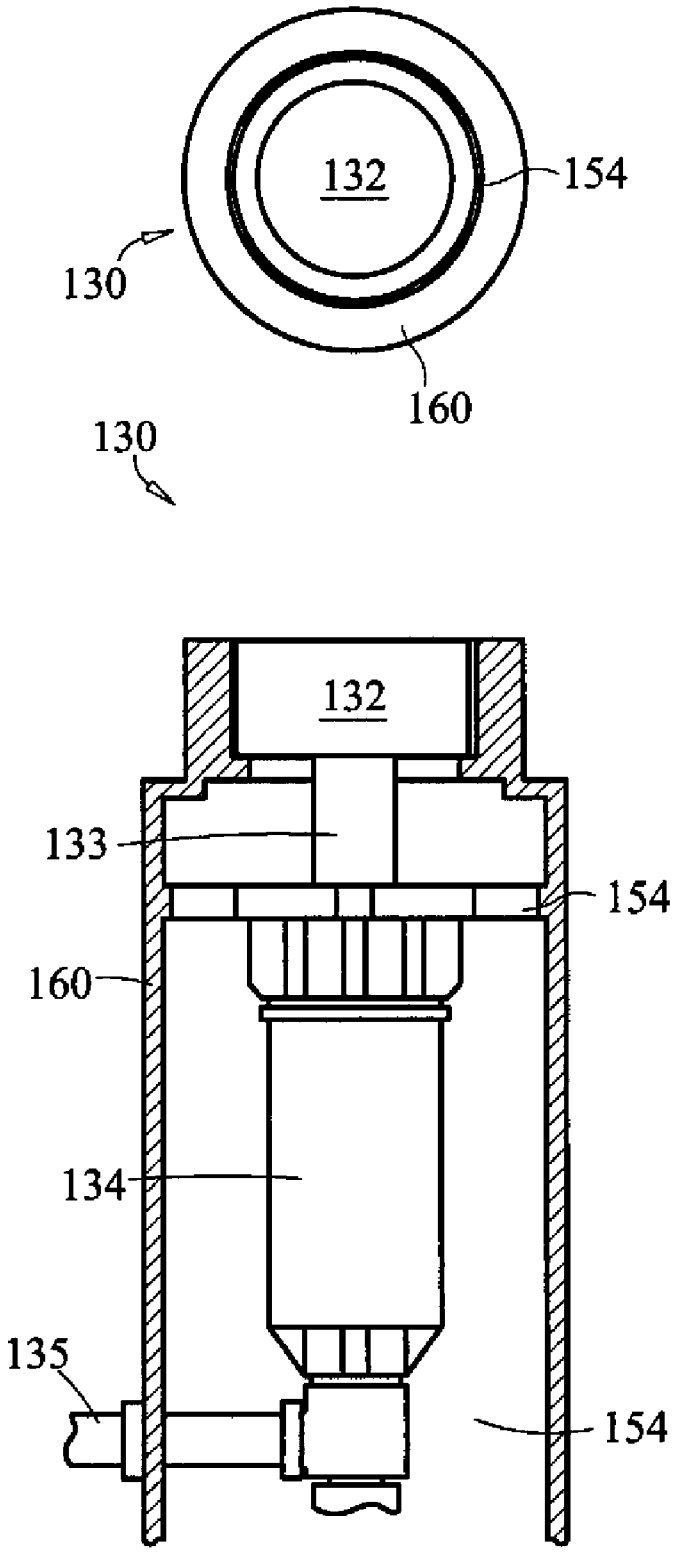
FIG. 12 is a top and side view of a fountain device in a closed position having a water pressure activated, spring action pop-up module according to an embodiment of the present invention.

FIGS. 11 and 12 illustrate a water pressure activated, spring action fountain device 130 shown in top and side views. In this embodiment, the spring action fountain device 130 comprises a fountain nozzle 132, a water supply riser 133, a spring action pop-up module 134, a water intake pipe 135, a spring 136, an outer cylinder module 137, an inner cylinder module 138, a lower module 139, a concentrically located drain 154, and associated plumbing. Together with FIG. 12, FIG. 11 illustrates how the spring action pop-up fountain device 130 operates under routine conditions. Water is introduced into a water intake pipe 135 that allows both hot and cold water to enter the water supply riser 133 so that it can be discharged through the fountain nozzle 132. A thin screen or mesh is ideally situated over the fountain nozzle 132 to prevent debris from entering the fountain nozzle 132.

As illustrated in FIG. 11, when the water is turned on, water pressure allows the spring within the spring action pop-up module 134 to be expanded raising the water supply riser 133 and fountain nozzle 132 to the open position and allowing the sink 12 to drain through at least one drain opening 154. When the flow of water is shut off, after a brief delay to allow for complete emptying of the sink 12, the spring module 134 lowers the water supply riser 133 and fountain nozzle 132 back down to the closed position as illustrated in FIG. 12. While the spring action pop-up fountain device 130 is in a closed position, the sink 12 is not permitted to drain. To close the drain 154 when the water is flowing, the center controller 60 is pressed causing the water supply riser 133 and fountain nozzle 132 to be lowered to the closed position as shown in FIG. 12. When drainage of the sink is again desired, the center controller 60 is pressed again and the water supply riser 133 and fountain nozzle 132 is raised to the open position as shown in FIG. 11. To open the drain 154 when the water is not flowing, the center controller 60 is pressed in the same manner as for the pop-up fountain device 80, causing water supply riser 133 and fountain nozzle 132 is raised to the open position as shown in FIG. 11. When drainage of the sink is no longer desired, the center controller 60 is pressed again causing the water supply riser 133 and fountain nozzle 132 to be lowered to the closed position as shown in FIG. 12.

The particular embodiments disclosed above and in the drawings are illustrative only, as the invention may be modified and practiced in different but equivalent manners apparent to those skilled in the art having the benefit of the teachings herein. Furthermore, no limitations are intended to the details of construction or design herein shown. It is therefore evident that the particular embodiments disclosed above may be altered or modified and all such variations are considered within the scope and spirit of the invention.

It is also to be understood that the following claims are intended to cover all of the generic and specific features of the invention herein described, and all statements of the scope of the invention, which as a matter of language, might be said to fall therebetween.

Now that the invention has been described,

What is claimed is:

1. An integrated drain and fountain device, comprising:

a stationary fountain nozzle integrated within a lower portion of a sink and disposed to produce a vertical stream of water at a user-defined water pressure;

a concentrically located drain to the fountain nozzle and adapted to receive collect water and further being in fluid communication with drain piping;

a water supply riser in fluid communication with a water intake pipe that allows both hot and cold water to enter the water supply riser so that water can be discharged through the fountain nozzle;

an o-ring stopper operationally controlled by a first controller located on a counter top so that when a downward force is applied to the first controller, the downward force is directed through a linkage including a flexible arm that redirects the downward force to an upward force causing the o-ring stopper to move vertically upwards from an open position to a closed position; and an outer cylinder module having a plurality of open grooves disposed concentrically to an inner cylinder module having a plurality of ridges extending from its periphery so that as the inner cylinder module rises in response to the upward force, the plurality of notches are raised up out of the plurality of open grooves of the outer cylinder module causing the inner cylinder module to rotate to an adjacent position and remain in the elevated closed position cylinder module that causes the inner module to rotate to an adjacent position as a compression force is applied using the linkage and controller.

2. The integrated drain and fountain device of claim 1, further comprising a second controller adapted to be rotated clockwise by a user to activate the flow of hot water, and counterclockwise to stop the flow of hot water.

3. The integrated drain and fountain device of claim 2, further comprising a third controller adapted to be rotated counterclockwise by a user to activate the flow of cold water, and clockwise to stop the flow of cold water.

4. The integrated drain and fountain device of claim 3, wherein the second and third controllers each further comprising an outer ring that controls the flow of water and a stationary inner disc.

5. The integrated drain and fountain device of claim 1, the first controller further comprising a first concentric control ring used to raise the o-ring stopper, a second concentric control ring used to control hot and cold water flow to the fountain nozzle, and a third concentric control ring used to control water pressure to the fountain nozzle.

6. An integrated drain and fountain device, comprising:

a fountain nozzle integrated within a sink and disposed to produce a vertical stream of water at a user-defined water pressure and adaptable to slide vertically within a concentrically located drain to the fountain nozzle, wherein the drain is adapted to receive and collect water and further being in fluid communication with drain piping;

a water supply riser in fluid communication with a water intake pipe that allows both hot and cold water to enter the water supply riser so that water can be discharged through the fountain nozzle;

a lower module operationally controlled by a first controller located on a counter top so that when a downward force is applied to the first controller, the downward force is directed through a linkage including a flexible arm so that the lower module redirects the downward force to an upward force causing the fountain nozzle to slide vertically upwards from a closed position to an open position;

an outer cylinder module and inner cylinder module disposed between the lower module and fountain nozzle, wherein the outer cylinder module having a plurality of open grooves disposed concentrically to the inner cylinder module having a plurality of ridges extending from its periphery so that as the inner cylinder module rises in response to the upward force from the lower module, the plurality of notches are raised up out of the plurality of open grooves of the outer cylinder module causing the inner cylinder module to rotate to an adjacent position and remain in the elevated open position; and a spring disposed between the fountain nozzle and the inner cylinder module that causes the inner module to remain in the adjacent position as a compression force is applied using the linkage and controller.

7. The integrated drain and fountain device of claim 6, further comprising a second controller adapted to be rotated clockwise by a user to activate the flow of hot water, and counterclockwise to stop the flow of hot water.

8. The integrated drain and fountain device of claim 7, further comprising a third controller adapted to be rotated counterclockwise by a user to activate the flow of cold water, and clockwise to stop the flow of cold water.

9. The integrated drain and fountain device of claim 8, wherein the second and third controllers each further comprising an outer ring that controls the flow of water and a stationary inner disc.

10. The integrated drain and fountain device of claim 6, the first controller further comprising a first concentric control ring used to raise the lower module, a second concentric control ring used to control hot and cold water flow to the fountain nozzle, and a third concentric control ring controls used to control water pressure to the fountain nozzle.

11. An integrated drain and fountain device, comprising:

a fountain nozzle integrated within a sink and disposed to produce a vertical stream of water at a user-defined water pressure and adaptable to slide vertically within a concentrically located drain to the fountain nozzle, wherein the drain is adapted to receive and collect water and further being in fluid communication with drain piping; and a spring action pop-up module in fluid communication with the fountain nozzle and a water intake pipe that allows both hot and cold water to enter the spring action pop-up module so that water can be discharged through the fountain nozzle, wherein the spring action pop-up module is operationally controlled by water pressure; and a first controller adapted to lower the fountain nozzle whereby sealing the drain so that the sink is filled with water.

12. The integrated drain and fountain device of claim 11, further comprising a second controller adapted to be rotated clockwise by a user to activate the flow of hot water, and counterclockwise to stop the flow of hot water.

13. The integrated drain and fountain device of claim 12, further comprising a third controller adapted to be rotated counterclockwise by a user to activate the flow of cold water, and clockwise to stop the flow of cold water.

14. The integrated drain and fountain device of claim 13, wherein the second and third controllers each further comprising an outer ring that controls the flow of water and a stationary inner disc.

15. The integrated drain and fountain device of claim 11, the first controller further comprising a first concentric control ring used to raise the fountain nozzle, a second concentric control ring used to control hot and cold water flow to the fountain nozzle, and a third concentric control ring controls used to control water pressure to the fountain nozzle.

* * * * *